United States Patent [19]

Spaulding

[11] 3,956,774

[45] May 18, 1976

[54] ITEM OF APPAREL

[75] Inventor: Ken Spaulding, New York, N.Y.

[73] Assignee: Spaldero Design, Inc., New York, N.Y.

[22] Filed: Dec. 6, 1974

[21] Appl. No.: 530,252

Related U.S. Application Data

[63] Continuation-in-part of Ser. No. 431,246, Jan. 7, 1974, abandoned.

[52] U.S. Cl. ..... 2/79; 2/78 B

[51] Int. Cl.[2] ..... A41D 13/02

[58] Field of Search ..... 2/78 R, 78 B, 79, 70, 2/2.1 R, 2.1 A, 78 A, 78 D

[56] References Cited

UNITED STATES PATENTS

| | | | |
|---|---|---|---|
| 2,131,177 | 9/1938 | Horton et al. | 2/79 |
| 2,521,767 | 9/1950 | Zecha | 2/79 |
| 3,261,024 | 7/1966 | Delaney | 2/70 X |

*Primary Examiner*—H. Hampton Hunter
*Attorney, Agent, or Firm*—Nolte and Nolte

[57] ABSTRACT

A jumpsuit or the like in which instead of the conventional seams, so called invisible sliding clasp fasteners are used to allow the removal or lowering of a nether undergarment without the need to remove the jumpsuit.

2 Claims, 8 Drawing Figures

ITEM OF APPAREL

This is a continuation-in-part of application Ser. No. 431,246, filed Jan. 7, 1974 and now abandoned.

This invention is concerned with an item of outer apparel of the kind comprising a trouser-like nether portion and an upper part normally extending over the shoulders of a wearer. Typical of this type of item are ski-suits and jumpsuits and for the sake of brevity the expression jumpsuits is used hereinafter to describe these items.

Jumpsuits have become a fashion item worn both during the evening and the daytime by women, as well as by men. However, a problem which exists especially for women is the fact that to remove or lower a nether undergarment when required, the jumpsuit must be removed from the wearer's shoulders and completely lowered so that it may become soiled by contacting a dirty floor. This has been so much a problem that it has prevented jumpsuits from becoming as popular with women as they might otherwise be.

According to this invention, to facilitate removal of a nether undergarment, there are provided so called invisible sliding clasp fasteners which normally close an opening by means of which the nether undergarments can be lowered.

Embodiments of this invention are illustrated in the accompanying drawings, in which.

Each of the embodiments of the invention in the drawings has the same basic construction and like parts are identified by like reference numerals throughout the figures in the drawings.

Figure 1:
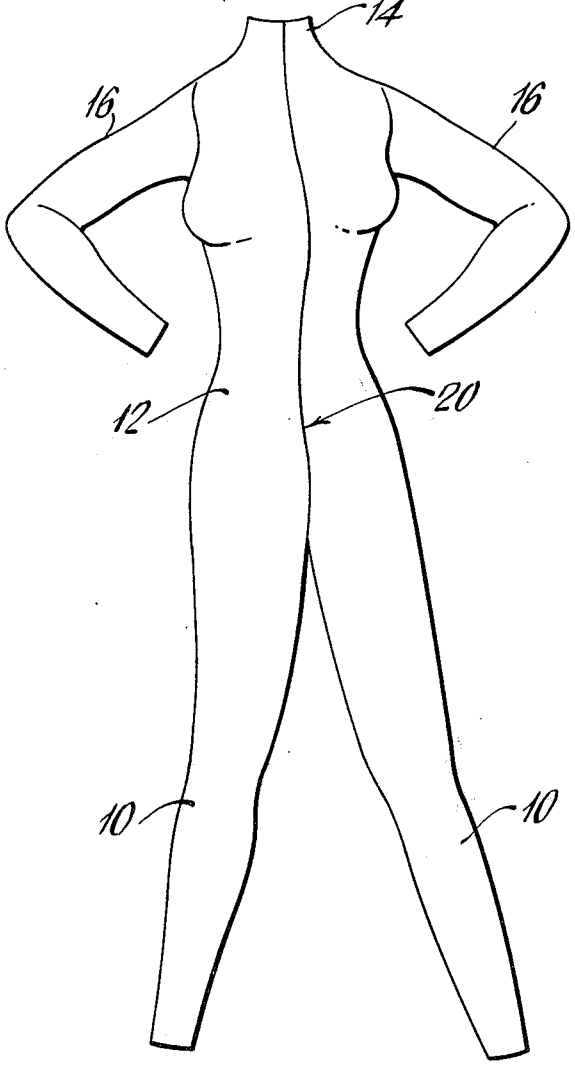
FIG. 1 is a front view of a garment according to this invention.

The embodiment of FIG. 1 comprises a nether portion with legs 10, a torso covering portion 12, neck 14 and sleeves 16.

In the conventional prior art garment of this type, a sliding clasp fastener would be provided at the back of the garment extending from the neck to the waist or small of the back and which would be used for donning and removing the garment. It will be appreciated that to remove or lower nether undergarments with such a conventional jumpsuit, it is necessary to remove the garment from the shoulders and lower it below the hips. According to this invention, a so-called invisible sliding clasp fastener is extended down the front of the garment, under the crotch and to at least above the waist at the back so that the seam opened by the fastener can be spread apart sufficiently to allow a nether undergarment to be lowered without having to remove the jumpsuit from the wearer's shoulders. It is to be appreciated that if the fastener extends only to the waist at the back of the jumpsuit, the seam opened by the fastener cannot be spread sufficiently to allow a nether undergarment to be lowered nor to avoid soiling.

Figure 2:
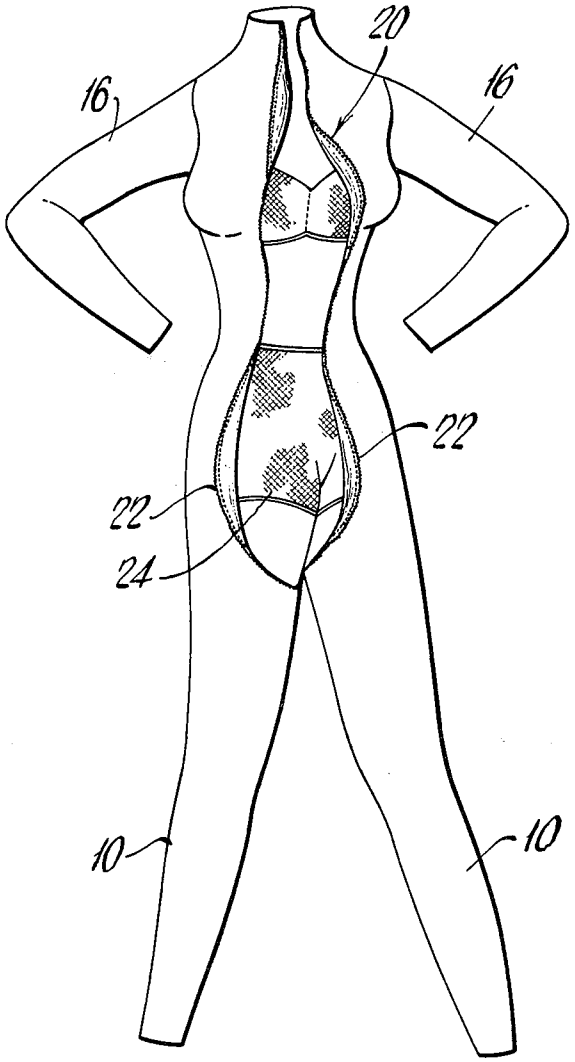
FIG. 2 shows the garment of FIG. 1 in the open position.

The sliding clasp fastener is indicated at 20 and has, as can be seen in FIG. 2, stringers 22 attached to the edges of the panels which are to be joined by the fastener. The fastener is of the kind known as an "invisible" fastener and is one which, when the fastener is closed, the stringers are covered by the marginal edges of the materials of the panels joined by the fastener. In this embodiment of the invention the fastener extends from the neck at the front of the jumpsuit down the front of the suit through the crotch and fully to the back of the neck. Such an arrangement has particular value in the manufacturing process since a single seam can be utilized; however it is possible to have the seam terminate at some point above the waist at the back, preferably in the region of the shoulder blades and still open the seam sufficiently for the purposes discussed hereabove. With such an arrangement, it is of course necessary to have a seam which is partly closed by the sliding clasp fastener and partly by stitching which is generally undesirable from a manufacturing point of view. At one or other end of the fastener the stringers may be joined together permanently as by stitching or they may have conventional co-operating clip means for releasably joining them so that in a situation in which the fastener extends completely through this crotch from the back of the neck to the front, the suit could be separated into two parts.

It will be appreciated that with the fastener opened as shown in FIG. 2, the nether undergarment, in this case panties 24, can be lowered without the need to remove the jumpsuit from the wearer's shoulders and hence without the risk of soiling the jumpsuit on a dirty floor.

Figure 6:
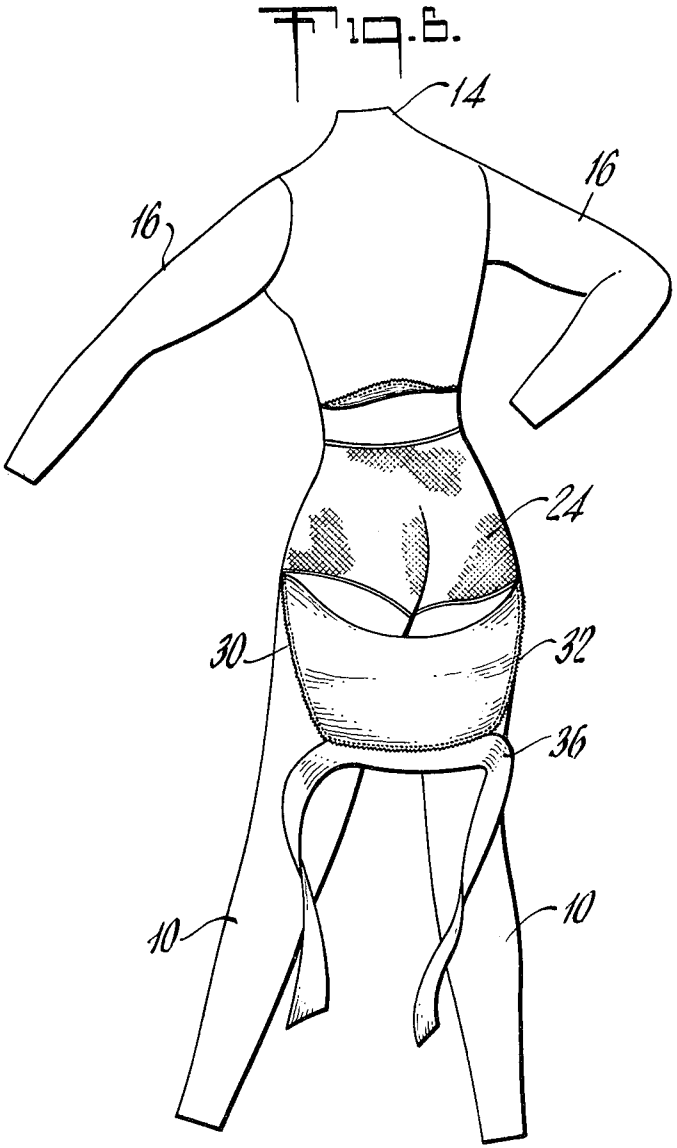
FIGS. 5 and 6 show another embodiment of the invention in the closed and opened positions, respectively.
Figure 5:
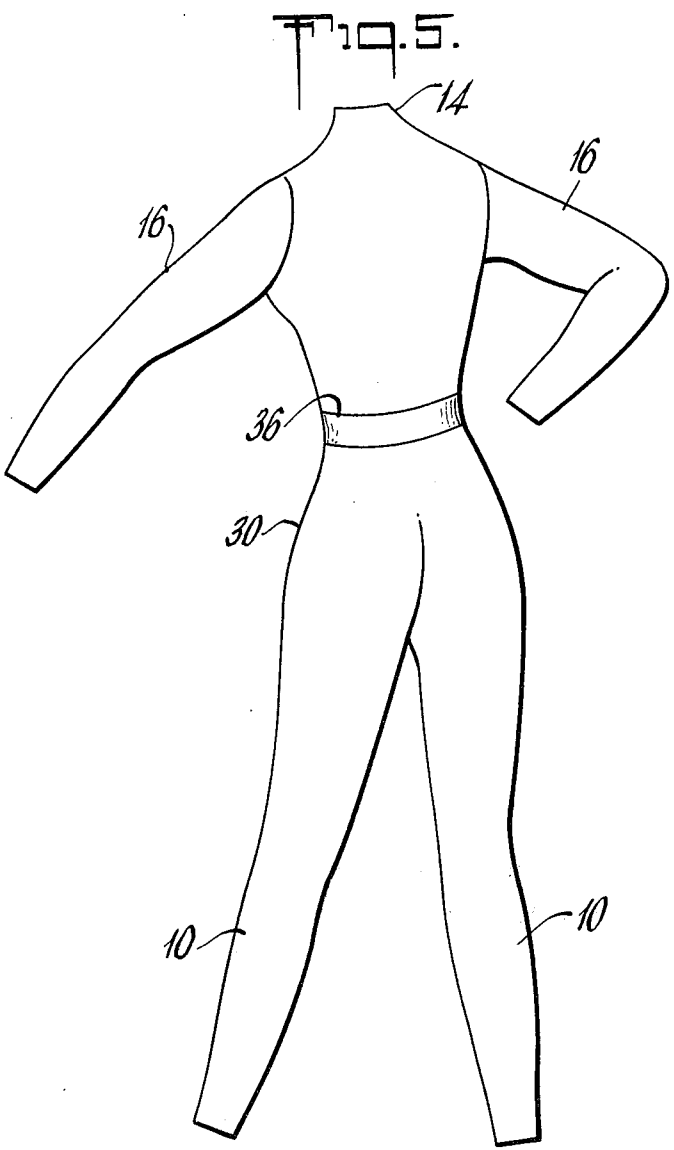

In the embodiment of FIGS. 5 and 6 there are two invisible sliding clasp fasteners 30 and 32 of which sliding clasp fastener 30 extends along the outside of the left thigh region of the garment from a point approximately at mid-thigh, to the waist and then around the waist to the small of the back. Fastener 32 extends along the outside of the right thigh portion of the garment, to the waist and around the waist to a point adjacent the end of the fastener 32. The garment has an attached belt-like portion 36 which is secured to the nether part of the jumpsuit, as can particularly be seen in FIG. 6, and which normally, i.e. when the fasteners are closed, would cover those portions of the fasteners which extend around the waist of the wearer.

Opening of the fasteners allows the portion of the garment defined by the fasteners to be moved to the position shown in FIG. 6 in which a nether garment can be lowered.

Figure 8:
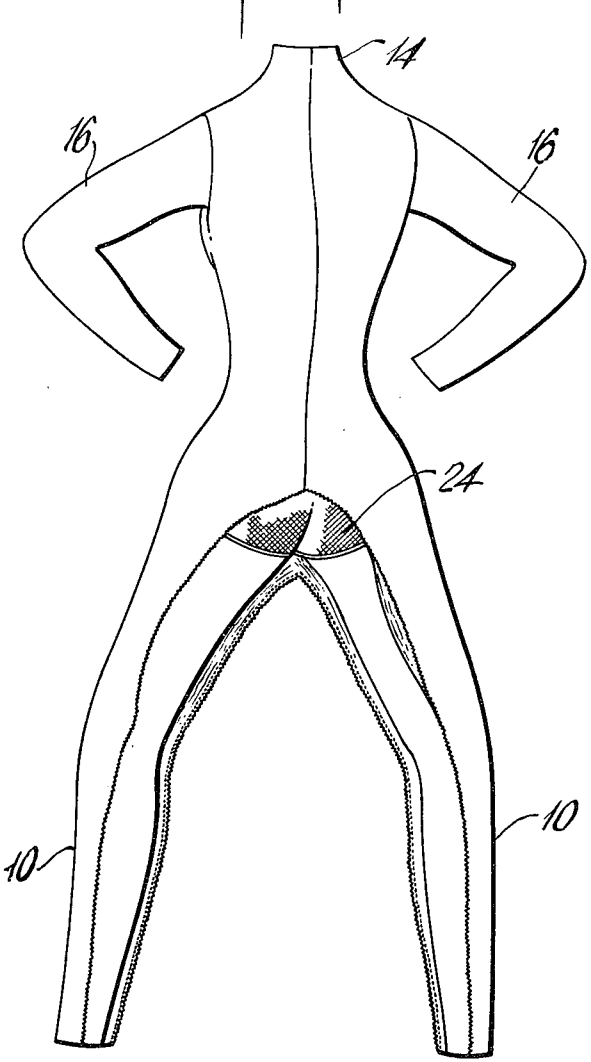
FIGS. 7 and 8 show still another embodiment of the invention in the closed and open positions, respectively.
Figure 7:
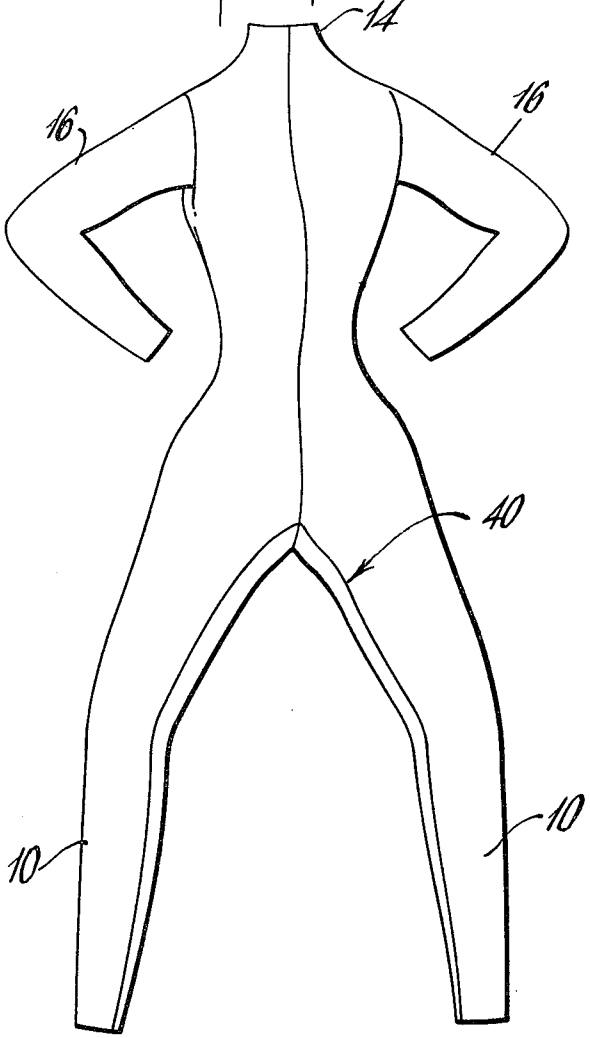
Figure 4:
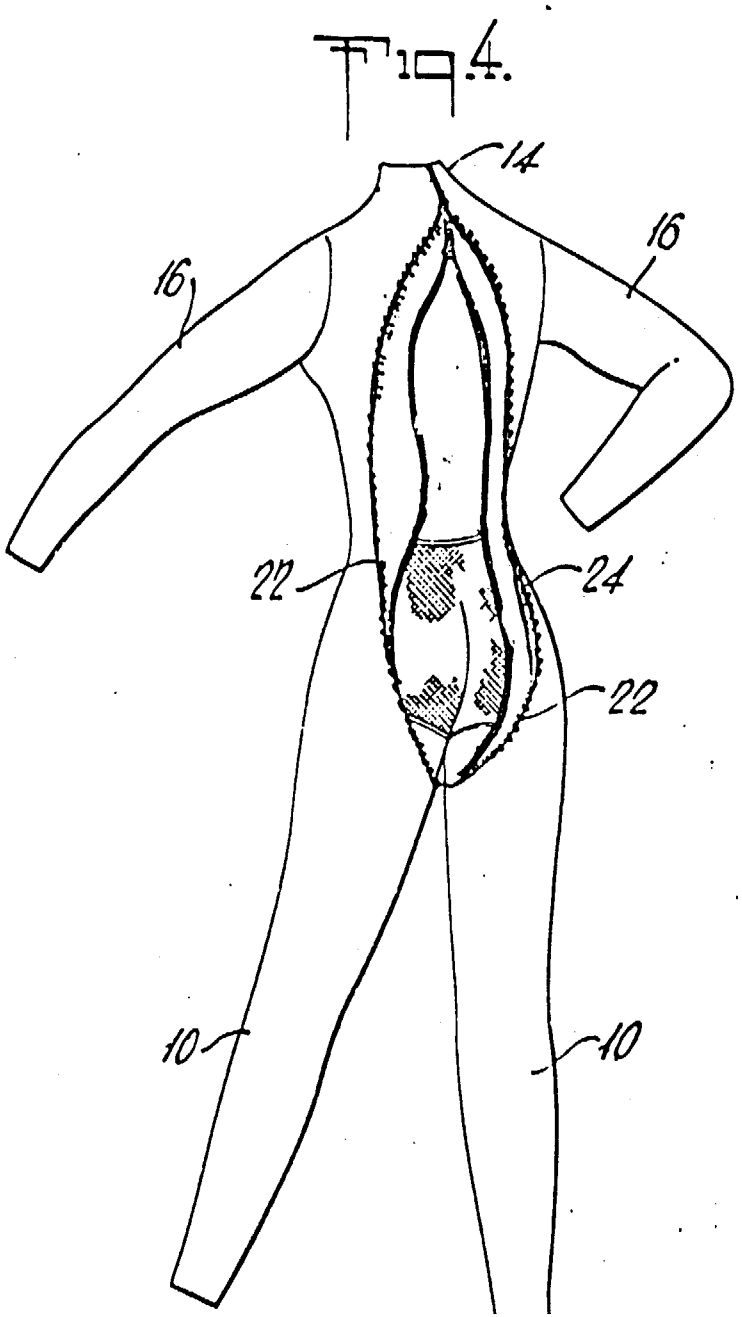
Figure 3:
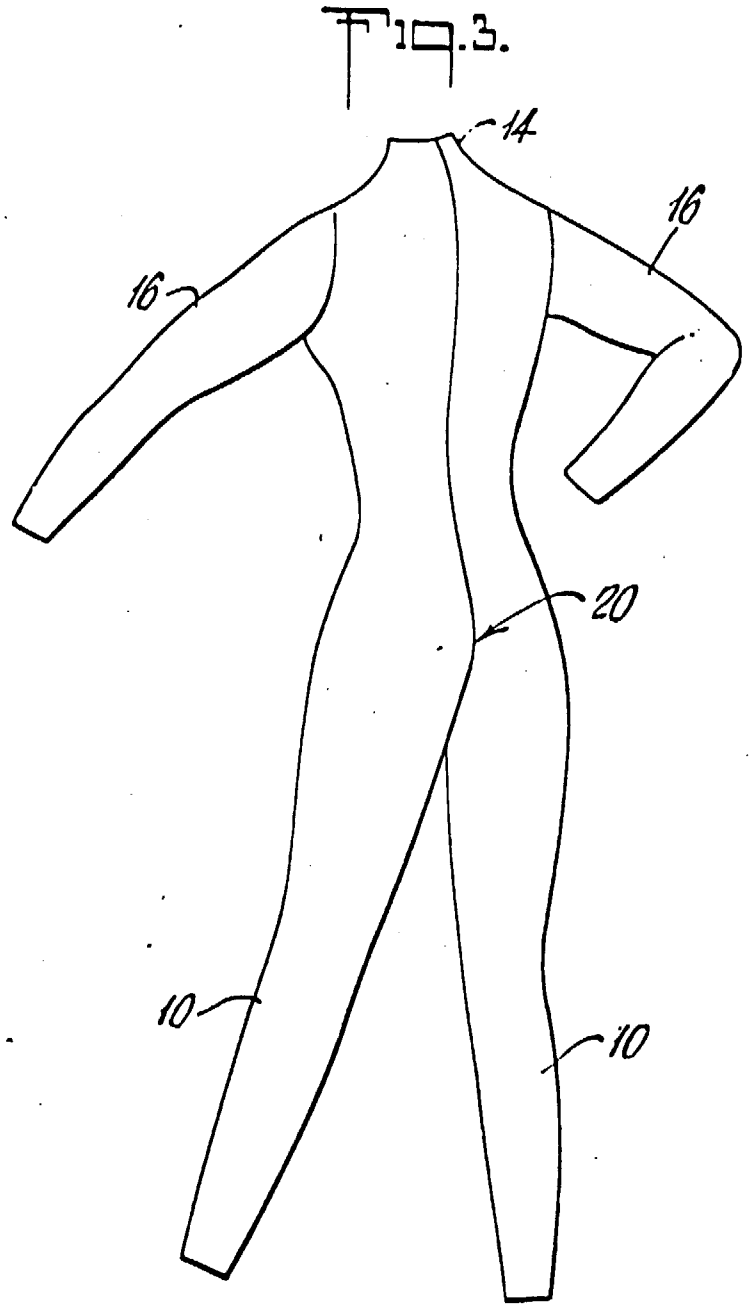

In the embodiment of FIGS. 7 and 8, a sliding clasp fastener 40 extends from the inside of one ankle to the inside of the other ankle along the normal inseam of the garment and the fastener can be opened so that the garment adopts the position shown in FIG. 8 in which a nether garment may be lowered as needed.

It will be appreciated that by virtue of the present invention a high fashion garment is available which does not have the disadvantages of the known such garments and in which the provision of means to avoid those disadvantages does not detract from the appearance of the garment.

What is claimed is:

1. An item of outer apparel comprising a trouser-like nether portion and an upper part for extending over the shoulders of a wearer, said item comprising at least two panels joined at a seam extending through a crotch region of the item, a sliding clasp fastener closing said seam to allow the seam to be opened and closed, material of the panels adjacent said seam constituting means for hiding said fastener when said seam is closed, said seam extending continuously from above a waist region at the front of the item, through the crotch region and upwardly at least to a shoulder blade region at the back of the item, said fastener constituting means for opening said seam and allowing the opened seam to be spread apart to facilitate the lowering of a nether undergarment without removing said upper part of said item from the shoulders of the wearer.

2. An item of apparel as claimed in claim 1 in which said fastener extends to an upper edge of the item at the back of the item.

* * * * *

UNITED STATES PATENT OFFICE

CERTIFICATE OF CORRECTION

Patent No. 3,956,774 Dated May 18, 1976

Inventor(s) Ken Spaulding

Figure 4:
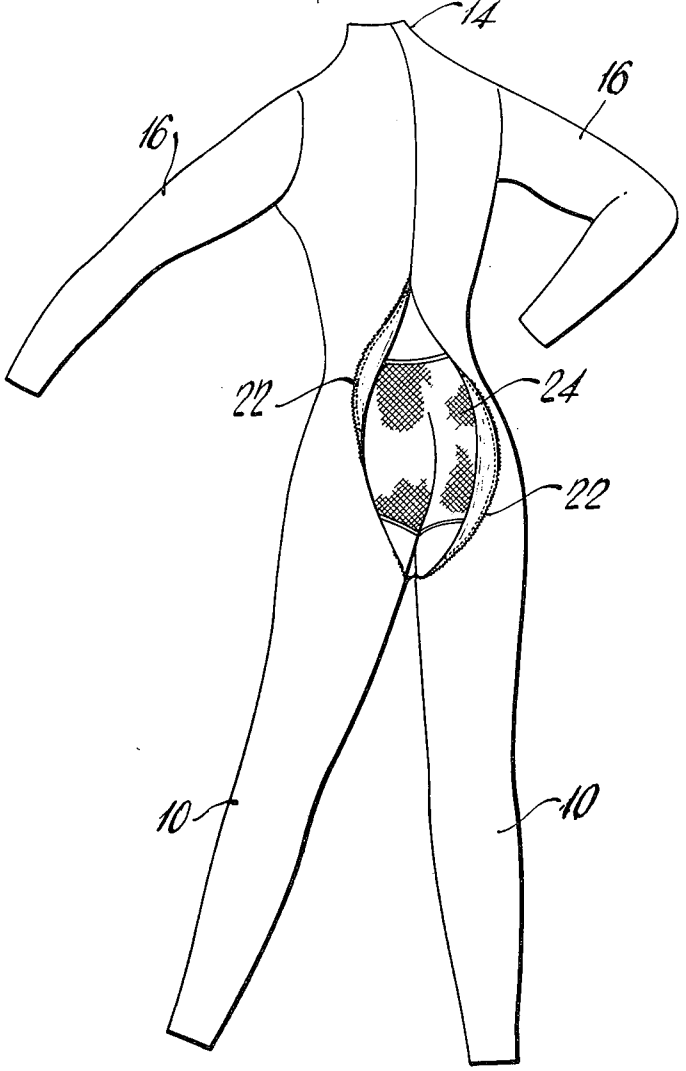
FIGS. 3 and 4 are back views of the embodiment of FIG. 1 in the closed and open positions, respectively.
Figure 3:
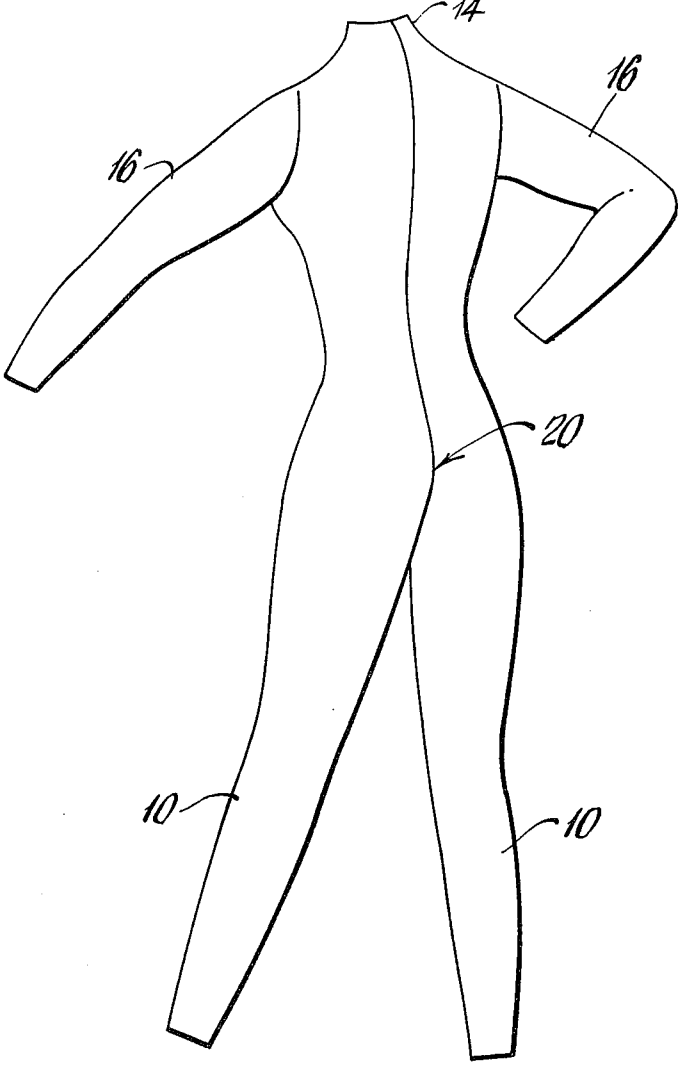

It is certified that error appears in the above-identified patent and that said Letters Patent are hereby corrected as shown below:

Figures 3 and 4 should appear as shown on the attached sheet.

Signed and Sealed this

Nineteenth Day of April 1977

[SEAL]

*Attest:*

RUTH C. MASON
*Attesting Officer*

C. MARSHALL DANN
*Commissioner of Patents and Trademarks*